US005146827A

United States Patent [19]

Komatsu et al.

[11] Patent Number: 5,146,827

[45] Date of Patent: Sep. 15, 1992

[54] SLITTER MOVING MECHANISM

[75] Inventors: Fumito Komatsu; Hiroyasu Shimokawa, both of Ina, Japan

[73] Assignee: Nippon Steel Corporation, Tokyo, Japan

[21] Appl. No.: 765,424

[22] Filed: Sep. 25, 1991

[30] Foreign Application Priority Data

Sep. 27, 1990 [JP] Japan ..... 2-257983

[51] Int. Cl.[5] ..... B26D 1/24; B26D 5/06

[52] U.S. Cl. ..... 83/482; 83/501; 83/564; 83/676

[58] Field of Search ..... 83/500, 553, 564, 497, 83/506, 505, 507, 482, 481, 501, 676

[56] References Cited

U.S. PATENT DOCUMENTS

| | | | |
|---|---|---|---|
| 2,212,457 | 8/1940 | Schrier | 83/482 |
| 2,664,950 | 1/1954 | Morgan et al. | 83/482 |
| 3,080,784 | 3/1963 | Schneider | 83/482 |
| 3,185,010 | 5/1965 | Printz et al. | 83/482 |
| 3,511,123 | 5/1970 | Smith | 83/482 |
| 3,892,156 | 7/1975 | Johnstone | 83/501 X |
| 4,474,096 | 10/1984 | Müller | 83/482 |
| 4,506,577 | 3/1985 | Shinomiya et al. | 83/564 X |
| 4,905,554 | 3/1990 | Cavagna | 83/482 |

FOREIGN PATENT DOCUMENTS

| | | | |
|---|---|---|---|
| 1070018 | 11/1959 | Fed. Rep. of Germany | 83/482 |

*Primary Examiner*—Douglas D. Watts
*Assistant Examiner*—Clark F. Dexter
*Attorney, Agent, or Firm*—Pollock, Vande Sande & Priddy

[57] ABSTRACT

A slitter moving mechanism includes an upper and a lower blade unit with an upper and lower blade respectively, the upper blade being movable between a slitting position to slit a web in a feed direction and a retracted position wherein the web can pass between the blades without being slit; a supporting member vertically and laterally movable within predetermined ranges and rotatably supporting the upper blade, a biasing member for upwardly biasing the supporting member and generating a coupling force for laterally moving the upper blade in a separating direction away from the lower blade; and guide member for restraining lateral movement of the upper blade in the separating direction beyond a predetermined distance and for guiding the vertical movement of the supporting member between the slitting and retracted position; the upper blade unit including a lowering device for lowering the supporting member and for generating another coupling force to swing the upper blade into contact with the lower blade, the lowering device including a vertical slot in the support member and a stationing pin for guiding vertical movement of the support member to a lowermost position in which the pin contacts an upper edge of the slot and whereupon the supporting member is swingable about the pin for allowing the lateral movement of the upper blade into contact with the lower blade.

2 Claims, 5 Drawing Sheets

SLITTER MOVING MECHANISM

FIELD OF THE INVENTION

The present invention relates to a slitter moving mechanism of the type including an upper blade unit having an upper blade and a lower blade unit having a lower blade for slitting a transported web in a feed direction, wherein the upper blade is movable between a slitting position to slit a web by abutting the upper blade with the lower blade and a retracted position where the web is allowed to pass through between the upper and lower blades without being slit.

BACKGROUND OF THE INVENTION

Slitters which slit a long web, such as a paper or a cloth, in a transporting direction of the web to provide a predetermined width of a web have been used in various fields. To change a width of a web to be slit, it is necessary to provide a slitter moving mechanism, in which several slitters are arranged at intervals corresponding to several widths. One or more upper blades are moved to slitting positions for serving as slitters whereas they are retracted to retracted positions to stop the function of slitters when not used.

FIGS. 5 and 6 are diagrammatic front and side views showing a substantial structure of a conventional slitter moving mechanism according to the prior art. The slitter includes an upper blade unit 42, having an upper blade 42*a*, and a lower blade unit 43 having a lower blade 43*a*. The upper blade 42*a* and lower blade 43*a* are brought into contact with each other to rotate in a web transporting direction (arrows X, Y in FIG. 6) at positions where the upper and lower blades 42*a* and 43*a* come into contact with the web 41, so that the web 41 which passes between the upper and lower blades 42*a* and 43*a* is slit.

The upper blade 42*a* is provided so that it is movable beween a slitting position, indicated by the solid line in FIG. 5, and a retracted position shown by the dot-and-dash line where the web 41 is prevented from passing through there. A supporting member 42*b* on which the upper blade 42*a* is mounted is spring-biased by a coil spring 42*c* so as to withdraw the upper blade 42*a* to the retracted position and the upper blade 42*a* is moved to the slitting position so as to abut with the lower blade 43*a* by energizing a solenoid 42*d*.

In the conventional slitter moving mechanism, the displacement d2 of the upper blade 42*a* becomes excessively large (15 mm, for example) since as shown in FIG. 5 the upper blade 42*a* is diagonally moved. This can cause the transmission element 42*e*, such as a chain or a belt, which rotates the upper blade 42*a* becomes twisted and exerts a lateral force on the transmission element 42*e*, causing the latter to move out of the transmission sprocket wheel or pulley.

To avoid such an accident of the transmission element 42*e* the upper blade 42*a* might be lifted vertically and upwardly from the slitting portion. However, when the upper blade 42*a* is moved only in a vertical direction, it happens that the upper blade 42*a* rides over the lower blade 43*a* without making side-by-side contact therebetween due to machining errors, attachment errors, plays thereof, etc. of the upper blade 42*a* or lower blade 43*a*.

To eliminate the above described problems of overriding of the upper blade and moving of the transmission element out of the pulley, the upper blade 42*a* may be slightly moved in the lateral direction of the arrow Z in FIG. 5 from the slitting position, to be disengaged from the lower blade 43*a*, and then the upper blade 42*a* may be elevated in the arrow direction W and moved to the retracted position. When the upper blade 42*a* is to move from the retracted position to the slitting position, the upper blade 42*a* is operated in the reverse sequence By moving the upper blade 42*a* in this fashion with slight lateral displacement of the upper blade 42*a*, for example, about 0.5 mm enables the transmission element 42*e* is prevented from being displaced from the sprocket wheel or the pulley This also prevents the overriding of the upper 42*a*. Such lateral and vertical movements of the upper blade 42*a* make the slitter moving mechanism more complicated thus causing a considerable rise in failure rate and equipment cost of the slitter moving mechanism.

SUMMARY OF THE INVENTION

Accordingly, it is an object of the present invention to a slitter moving mechanism which is capable of positively moving the slitter but has less complicated construction than the slitter moving mechanism of the prior art.

To this and other objects the present invention a slitter moving mechanism of the type including upper blade unit having an upper blade and a lower blade unit having a lower blade arranged to slit a transported web in a transporting direction, the upper blade being movable between a slitting position to slit a web by abutting the upper blade with the lower blade and a retracted position where the web is allowed to pass between the upper and lower blades without being slit. The slitter moving mechanism comprises a supporting member for rotatably supporting the upper blade, the supporting member being vertically movable and outwardly swingable within predetermined ranges; a biasing member for upwardly biasing the supporting member so as to generate a coupling force for swinging the upper blade in a separating direction to separate the upper blade from the lower blade; guide means for restraining the upper blade from swinging further in the separating direction beyond a predetermined distance from the lower blade and for guiding the vertical movement of the supporting member; and lowering means provided on the upper blade unit for lowering the supporting member to generate another coupling force for swinging the upper blade in a contact direction to bring the upper blade into contact with the lower blade.

In the slitter moving mechanism, the supporting member includes a long slot and a stationary pin to support the upper blade so that it is vertically and laterally movable.

The upper blade unit may comprise bearing means for bearing the upper blade for rotation; and the guide means may be arranged to oppositely face the bearing means for restraining the upper blade from moving away from the lower blade beyond the predetermined distance.

In the slitter moving mechanism according to the present invention, the upper blade is located at the retracted position when the web is not severed. In slitting the web, the supporting member of the upper blade unit is subjected to a coupling force from the lowering means but the upper blade moves to the lowermost level without swinging due to a biasing force from a biasing member. Thus, the upper blade is positioned at the slitting position When the lowering means is deactivated, the supporting member is swung by the biasing member in a direction opposite to the contact direction of the upper blade. As a result the supporting member is brought into contact with a guide unit, so that the upper blade is moved upwardly to the retracted position while the swinging thereof is restrained by the guide unit. This leads the upper blade to the retracted position.

By providing the biasing member and the lowering means for generating a coupling of forces in the upper blade, both the vertical movement and the lateral movement of the upper blade can be positively achieved with a simple construction. The slitter moving mechanism of the present invention may be preferably used in slitting a sheet of paper in a feed direction of the paper in a large-size electrostatic plotter or the like facility.

DETAILED DESCRIPTION OF THE PREFERRED EMBODIMENTS

Figure 4:
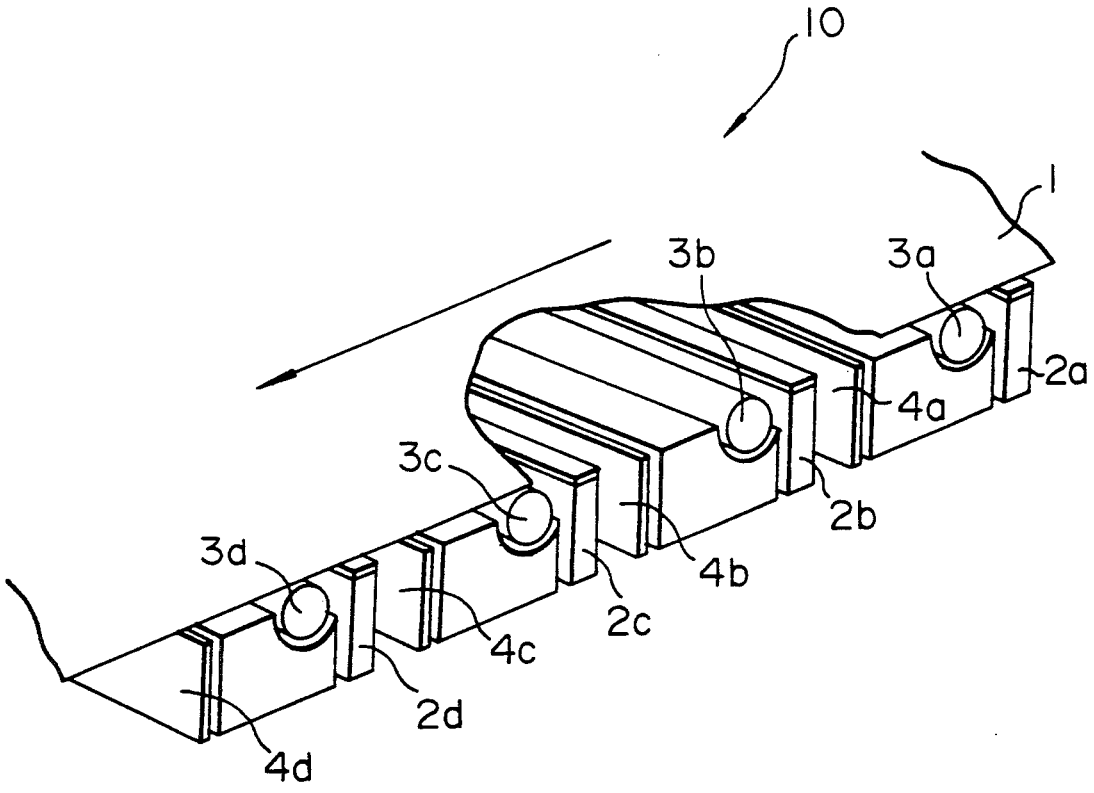
FIG. 4 is an illustration of the principle of the electrostatic printing in the electrostatic plotter of FIG. 3 to be provided with the slitter moving mechanism of FIG. 1.
Figure 5:
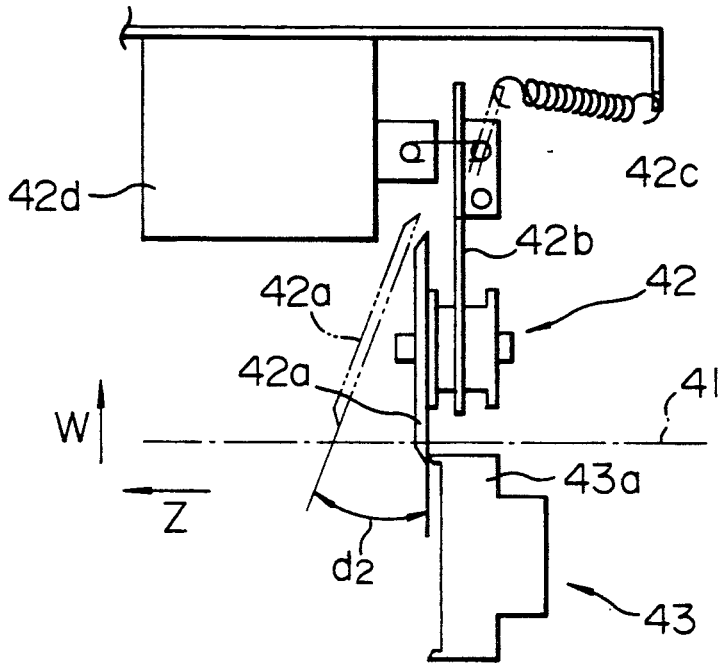
FIG. 5 PRIOR ART
FIG. 5 is a diagrammatic front view of the conventional slitter moving mechanism.
Figure 6:
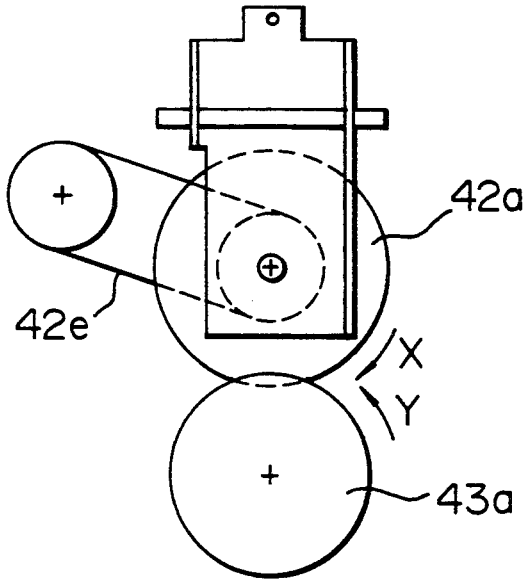
FIG. 6 PRIOR ART
FIG. 6 is a diagrammatic side view of the slitter moving mechanism of FIG. 5.

FIG. 4 illustrates a principle of the electrostatic printing in an electrostatic plotter which is provided with a slitter moving mechanism as one embodiment of the present invention.

A long continuous sheet of paper (printing paper) 1 is transported in a direction indicated by the arrow shown in FIG. 4. A recording unit 10 is provided below the paper 1, and includes many recording heads 2*a*, 2*b*, 2*c* and 2*d* aligned in the direction of the width of the paper 1, toner rollers 3*a*, 3*b*, 3*c* and 3*d* provided immediately downstream of the recording heads 2*a*, 2*b*, 2*c* and 2*d*, and vacuum heads 4*a*, 4*b*, 4*c* and 4*d* arranged immediately downstream of the toner rollers 3*a*, 3*b*, 3*c* and 3*d* for black, cyan, magenta and yellow, respectively. When the paper 1 passes over the recording unit 10, electrostatic latent images are formed on the paper 1 by the recording heads 2*a*, 2*b*, 2*c* and 2*d*, and then liquid toners are sprayed over the paper 1 from the toner rollers 3*a*, 3*b*, 3*c* and 3*d* located immediately downstream of respective recording heads 2*a*, 2*b*, 2*c* and 2*d*, so that the liquid toners adhere to paper 1 at the positions where the electrostatic latent images have been formed. Thereafter, excess liquid toners are sucked by the vacuum heads 4*a*, 4*b*, 4*c* and 4*d* downstream of the respective toner rollers 3*a*, 3*b*, 3*c* and 3*d*. This processing is applied to each of four colors, black, cyan, magenta and yellow, thereby allowing a multicolor picture to be printed on the paper 1.

Figure 3:
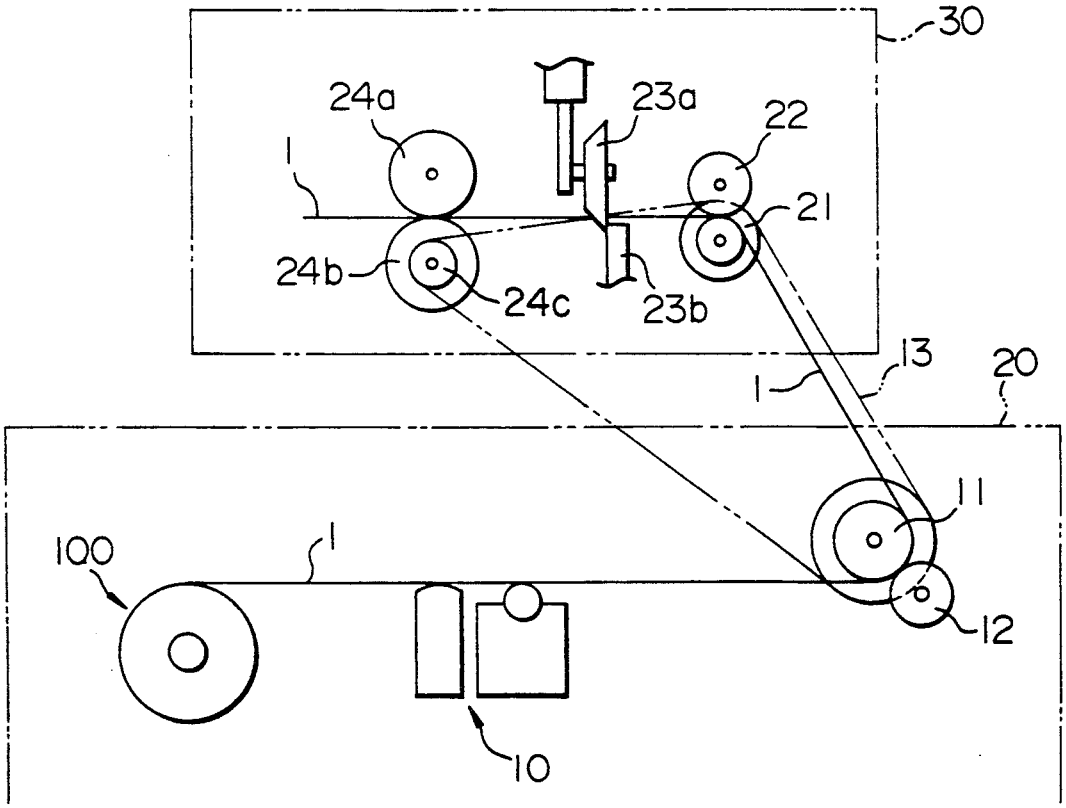
FIG. 3 is a diagrammatic view of a paper feed system of an electrostatic plotter.

FIG. 3 illustrates a paper transporting system in the electrostatic plotter. Paper sheet 1 unrolled from a roll of paper 100 passes over the recording unit 10, then is pinched between a drive roller 11 and a pinch roller 12, and is finally sent from a drawing unit (main unit) 20 to a cutting unit 30 by the drive roller 11. The paper 1 transported into the cutting unit 30 is pinched between a transmission roller 21 and a pinch roller 22, and is sent out further downstream by the transmission roller 21. Downstream of the transmission roller 21, there are arranged upper cutting blades 23*a* and lower cutting blades 23*b* which are moved crosswise (that is, in a direction perpendicular to the sheet of FIG. 3) of the paper 1 to sever the paper 1. Downstream of the cutting blades 23*a* and 23*b* a plurality of upper slitting blades 24*a* and lower slitting blades 24*b* are mounted on respective shafts 25*a* and 25*b* at appropriate intervals in the crosswise direction of the paper 1 for longitudinally slitting the paper 1. Then, a drive roller 11, a transmission roller 21-and a lower blade 24*c* of the slitting blade 24*b* are connected to each other through a belt 13 and driven by a motor (not shown) for driving the drive roller 11. Further, the drive roller 11 is directly connected to the shaft of the motor and the transmission roller 21 and the lower blade 24*c* of slitting blade 24*b* are connected to the motor through a belt 13 and a clutch mechanism (not shown). While the paper 1 is severed by moving the cutting blades 23*a* and 23*b* in the widthwise direction of the paper 1, the clutch mechanism is controlled to stop both the transmission roller 21 and the slitting blade 24*b* although the drive roller 11 continues to rotate. In this manner, the paper 1 on which a predetermined print has been conducted is severed by the cutting blades 23*a* and 23*b* and the slitting blades 24*a* and 24*b* to a predetermined size, for example, A4 size.

Figure 1:
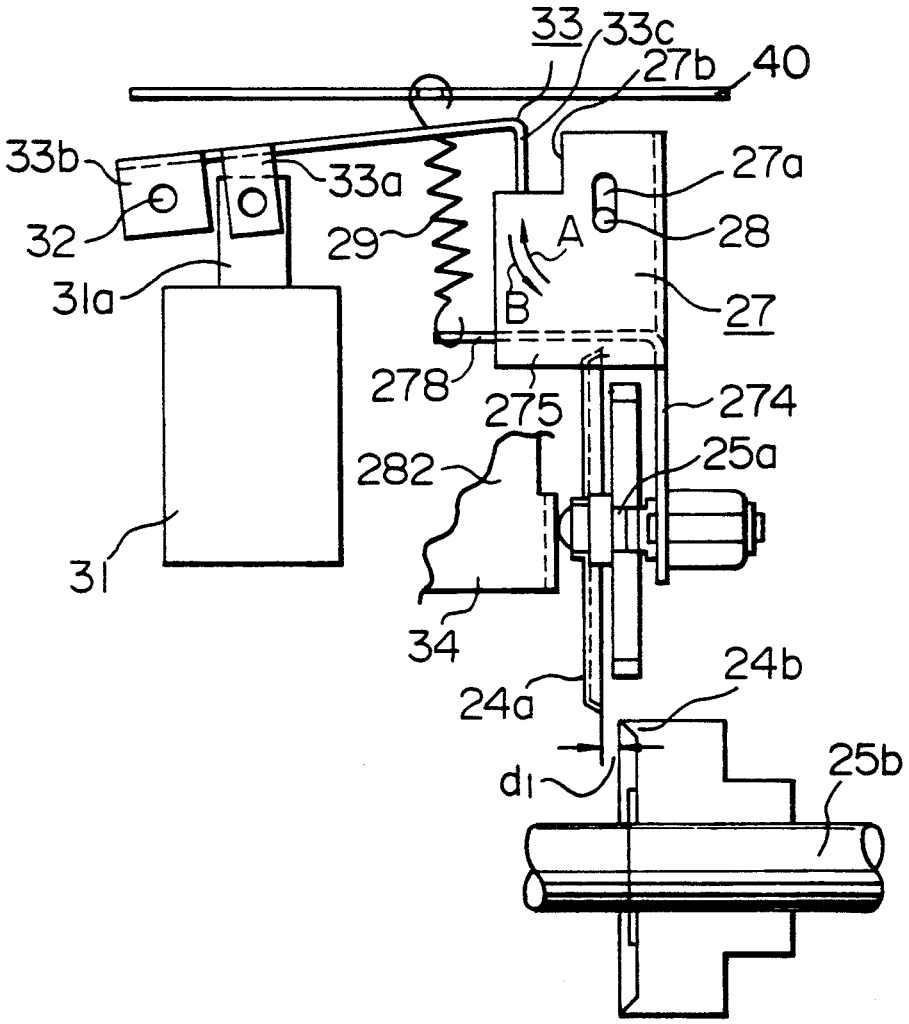
FIG. 1 is a diagramatic elevation of a slitter moving mechanism according to an embodiment of the present invention.
Figure 2:
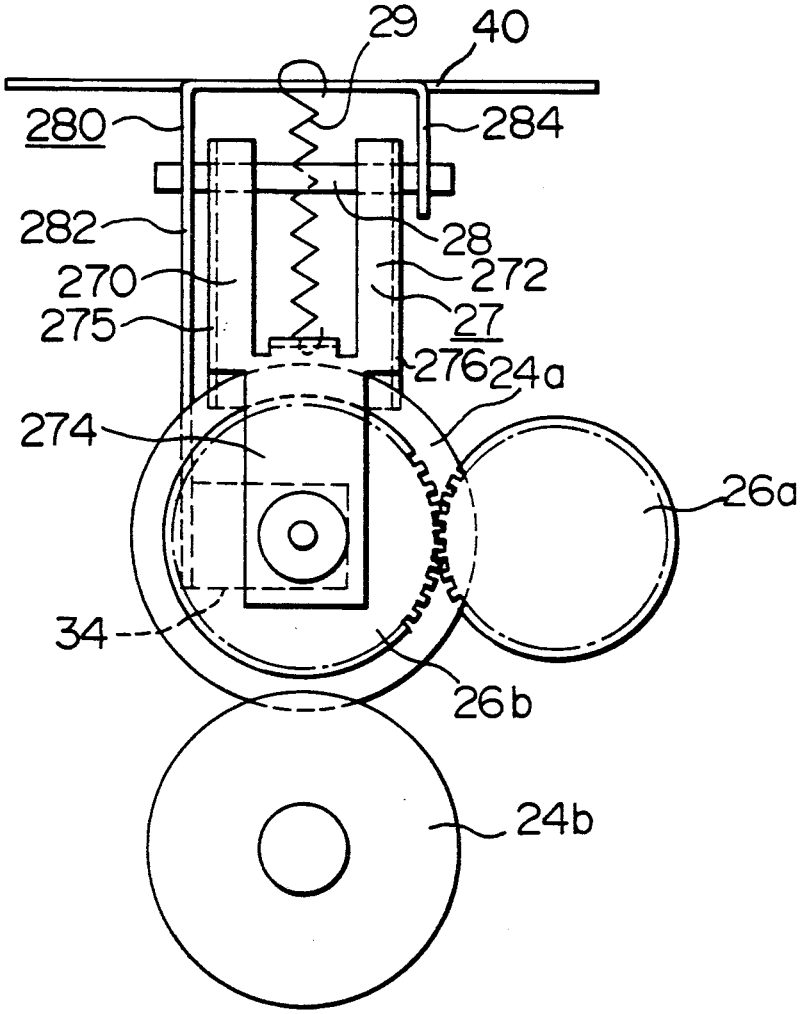
FIG. 2 is a right side view of the slitter moving mechanism of FIG. 1.

FIGS. 1 and 2 illustrate a slitter moving mechanism constructed according to an embodiment of the present invention. The lower blade 24*b* is driven by rotating a rotary shaft 25*b* by a motor, not shown, whereas the upper blade 24*a* is driven by the motor through gears 26*a* and 26*b*. The upper blade 24*a* is rotatably supported on a substantially Y-shaped supporting member 27. The supporting member 27*a* is provided with a long slot 27*a* into which a pin 28 is inserted, so that the supporting member 27 is vertically movable within a size of the long slot 27*a* and rotatable around the pin 28.

That is, the supporting member 27 has a pair of parallel arms 270 and 272 and a leg 274. Each of the arms 270 and 272 is provided with flanges 275 and 276 vertically extending there from. The flanges 275 and 276 are each provided with a vertical through slot 27*a*. A pin 28 slidably and rotatably passes through the slots 27*a* so that the supporting member 27 may be vertically movable by the vertical length of the slots 27*a*. The pin 28 is attached at opposite ends thereof to vertical flanges 282 and 284 of an inverted L-shaped bracket 280 secured to the frame 40. The supporting member 27 may be swung about the pin 28. The supporting member 27 is held by a coil spring 29. The coil spring 29 is attached at one end to the frame 40 and at the other end to a lug 278 which is integrally formed with the leg 274 of the supporting member 27 and is vertically bent sidewise. The other end of the coil spring 29 is attached to the distal end of the lug 278, and is located leftwardly from the pin 28 in FIG. 1, so that a coupling of forces are generated in the supporting member 27 in directions of the arrows A and B. To restrain the upper blade 24*a* from excessively swinging in the direction of the arrow A, a guide plate 34 is formed integrally with the vertical flange 282 of the bracket 280 so that the guide plate 34 oppositely faces the shaft 25*a* of the upper blade 24*a* for making a contact. The guide plate 34 also serves to guide vertical movement of the supporting member 27. A solenoid 31 is mounted to the frame 40, and the core 31*a* of the solenoid 31 is pivotally connected to a lug 33*a* of a cantilever 33. The cantilever 33 is vertically pivotally connected at the proximal end 33*b* thereof to the frame 40 through a pivot 32, and the distal end 33*c* thereof is brought into contact with shoulders 27*b* of the flanges 275 and 276. When the solenoid 31 is energized, the core 31*a* is pulled in, so that the cantilever 33 pivots downwardly about the pivot 32. As a result, the distal end 33*c* of the cantilever 33 depresses the supporting member 27 against the biasing force of the spring 29. In FIG. 1, the distal end 33*c* applies a downward force to the left side of the flanges 275 and 276 with respect to the pin 28, whereby one of the coupling forces in the direction of the arrow B is exerted on the supporting member 27.

Several slitters thus constructed are aligned across the sheet of paper 1 as described previously. To slit the sheet of paper 1 to a predetermined width, the slitters are located in predetermined positions. One of or more of the slitters are in retracted positions shown in FIG. 1 whereas the other slitters are in slitting positions shown in FIG. 2.

The operation of one of the slitters will be described hereinafter where the upper blade 24*a* is movable between the retracted position in FIG. 1 and the slitting position of FIG. 2.

When the solenoid 31 is energized, the supporting member 27 is depressed by the lever 33. In this event, the supporting member 27 is spring-biased by the spring 29, and hence the supporting member 27 descends by the guide of the pin 28 and the guide plate 34 without swinging. The supporting member 27 moves downwardly until the pin 28 is brought into contact with the upper end wall of the slot 27*a*, and no further downward movement is possible. Then, the supporting member 27 slightly swings about the pin 28 in the direction of the arrow B, so that the upper blade 24*a* comes into contact with the side of the lower blade 24*b*. Thus, the upper blade 24*a* is placed in the slitting position.

When the solenoid 31 is deenergized with the upper blade 24*a* placed in the slitting position, that is, the upper blade 24*a* contacting the lower blade 24*b*, the upper blade 24*a* turns in the direction of the arrow A by the spring 29, so that the shaft 25*a* of the upper blade 24*a* is brought into contact with the guide plate 34 of the bracket 280. Then, the upper blade 24*a* ascends along the guide plate 34 to the retracted position shown in FIG. 1. In this manner, coupling of forces are generated by a simple construction: the supporting member 27 is lifted or depressed at positions horizontally away from the pin 28. This enables the upper blade 24*a* to move vertically and laterally in FIG. 1. With such vertical and lateral movements of the upper blade 24*a*, lateral displacement dl of the upper blade 24*a* may be as large as dimensional errors and attachment errors of the upper blade 24*a* and the lower blade 24*b*, for example, 0.5 mm.

In the embodiment previously described, the pin 28 is stationary and the slots 27*a* are formed through the supporting member 27, while the supporting member 27 may be provided with a pin and the slot is formed through members mounted to the frame 40.

The upper blade 24*a* may be driven by the motor through a chain or a belt in place of the gears 26*a* and 26*b*.

The transmission roller 21 and the lower blades 24*b* of the slitter may be rotated by individual motors without using the belt 13.

What is claimed is:

1. A slitter moving mechanism including an upper blade unit having an upper blade and a lower blade unit having a lower blade, the upper blade being movable between a slitting position to slit a web and a retracted position wherein the web can pass through between the upper and lower blades without being slit, the upper blade in cooperation with the lower blade being adaptable to slit the web at the slitting position in a feed direction of the web, said slitter moving mechanism further comprising:

a supporting member for rotatably supporting the upper blade, the supporting member being vertically and laterally movable within predetermined ranges;

a biasing member for upwardly biasing the supporting member and generating a coupling force for laterally moving said upper blade in a separating direction to separate said upper blade from the lower blade; and guide means for restraining lateral movement of the upper blade in the separating direction beyond a predetermined distance from the lower blade and for guiding the vertical movement of the supporting member between said slitting and retracted position;

the upper blade unit including lowering means for lowering the supporting member and for generating another coupling force to swing the upper blade in a contact direction and to bring the upper blade into contact with the lower blade, said lowering means including a vertical slot in said supporting member and a stationary pin for guiding vertical movement of said supporting member to a lower-most position in which said pin contacts an upper edge of said slot and where-upon said supporting member is swingable about said pin for allowing said lateral movement of the upper blade into contact with the lower blade.

2. A slitter moving mechanism as set forth in claim 1, wherein:

the upper blade unit includes bearing means for bearing the upper blade for rotation; and the guide means is positioned on the opposite side of the upper blade with respect to the bearing means for restraining the upper blade from moving away from the lower blade beyond the predetermined distance.

* * * * *